US012280936B2

(12) United States Patent
Rochau et al.

(10) Patent No.: US 12,280,936 B2
(45) Date of Patent: Apr. 22, 2025

(54) TOBACCO CAN COOLER

(71) Applicant: Prototitan, LLC, Albuquerque,, NM (US)

(72) Inventors: David Rochau, Albuquerque, NM (US); Christopher Clark, Jr., Mooresville, NC (US); Michael Bryce Gray, Mooresville, NC (US)

(73) Assignee: Prototitan, LLC, Albuquerque, NM (US)

( * ) Notice: Subject to any disclaimer, the term of this patent is extended or adjusted under 35 U.S.C. 154(b) by 180 days.

(21) Appl. No.: 18/304,978

(22) Filed: Apr. 21, 2023

(65) Prior Publication Data

US 2023/0339668 A1 Oct. 26, 2023

Related U.S. Application Data

(60) Provisional application No. 63/363,338, filed on Apr. 21, 2022.

(51) Int. Cl.
*B65D 81/38* (2006.01)
*A24F 23/00* (2006.01)

(52) U.S. Cl.
CPC ..... *B65D 81/382* (2013.01); *A24F 23/00* (2013.01)

(58) Field of Classification Search
CPC ..... B65D 81/382; B65D 81/383; A24F 23/00
See application file for complete search history.

(56) References Cited

U.S. PATENT DOCUMENTS

| | | | | |
|---|---|---|---|---|
| 7,798,319 | B1 * | 9/2010 | Bried | B65D 51/16 220/366.1 |
| 10,670,323 | B2 | 6/2020 | Alexander et al. | |
| 10,743,708 | B2 | 8/2020 | Alexander et al. | |
| 10,852,047 | B2 | 12/2020 | Alexander | |
| 10,941,972 | B2 | 3/2021 | Alexander et al. | |
| 10,989,466 | B2 | 4/2021 | Alexander et al. | |
| 11,067,327 | B2 | 7/2021 | Alexander et al. | |
| 11,083,332 | B2 | 8/2021 | Alexander et al. | |
| 11,089,891 | B2 | 8/2021 | Alexander | |
| 11,118,827 | B2 | 9/2021 | Alexander et al. | |
| 2006/0163263 | A1 | 7/2006 | Helline | |
| 2013/0292279 | A1 * | 11/2013 | Bengtsson | B65D 85/10 206/245 |

(Continued)

FOREIGN PATENT DOCUMENTS

WO 2020263710 A1 12/2020

*Primary Examiner* — Emmanuel E Duke
(74) *Attorney, Agent, or Firm* — Sisson & Banyas, Attorneys at Law, LLC; Jeffrey J. Banyas

(57) ABSTRACT

A tobacco can cooler comprises a lid comprising a lid inner shell, and a base comprising a base inner shell. The lid inner shell has a lid inner shell sidewall and a lid first end wall defining a first tobacco can chamber section while the base inner shell has a base inner shell sidewall and a base first end wall defining a second tobacco can chamber section. When the lid is engaged with the base, the first tobacco can chamber section and the second tobacco can chamber section may define a tobacco can chamber. The lid may comprise a lid outer shell sealed to the lid inner shell and/or the base may comprise a base outer shell sealed to the base inner shell. Sealing of the outer shell(s) to the inner shell(s) may create void(s) which may comprise an optional cooling media.

19 Claims, 7 Drawing Sheets

(56) References Cited

U.S. PATENT DOCUMENTS

| | | | | |
|---|---|---|---|---|
| 2014/0262903 | A1* | 9/2014 | Mitten | B65D 55/06<br>206/459.5 |
| 2017/0157106 | A1* | 6/2017 | Rogers | A61P 43/00 |
| 2019/0174822 | A1* | 6/2019 | Bjoerkholm | A24F 23/00 |
| 2020/0339338 | A1 | 10/2020 | Morris | |
| 2022/0071280 | A1* | 3/2022 | Patel | B65D 81/22 |
| 2022/0104543 | A1* | 4/2022 | Patel | B65D 43/0212 |
| 2022/0378089 | A1* | 12/2022 | Kirakosian | A24F 23/00 |

* cited by examiner

TOBACCO CAN COOLER

This application claims priority from U.S. Provisional Application No. 63/363,338 filed on 21 Apr. 2022 the teachings of which are incorporated by reference herein in their entirety.

BACKGROUND

Smokeless tobacco, sometimes referred to as chewing tobacco, dipping tobacco, or snuff, is used as a means for consuming tobacco without smoking. Typically, smokeless tobacco comprises loose-leaf tobacco which has been cut or shredded into smaller particles.

Use of smokeless tobacco involves chewing, sniffing, or placing an amount of the product between the users gums and their cheek or lip. The user's saliva along with pressure created by the user manipulating the jaw, cheek muscles, and/or lip muscles then extracts chemicals such as nicotine from the product.

Smokeless tobacco often comes in a small, sealed cannister—typically having a two-piece cylindrical construction. The two pieces may be thought of as a lid and a base with the lid being removable from the base to allow access to the smokeless tobacco product inside the hollow interior of the cannister.

In practice, carrying such a cannister on one's person—such as in a shirt or pants pocket—has many drawbacks. Most notably, body heat transferred from the person can warm the cannister and—in turn—also warm the smokeless tobacco product within the cannister. This can lead to a reduction in freshness of the smokeless tobacco product and in some cases outright spoliation. The effects of body heat are only amplified when the cannister is stored in a user's pocket where the insulative effects of the pocket's fabric retain such heat.

The need exists, therefore, for an improved device and method for storing a smokeless tobacco product.

SUMMARY

Described herein is a tobacco can cooler. The tobacco can cooler comprises a lid and a base.

The lid comprises at least a lid inner shell, a lid inner shell first end wall, and a lid inner shell. sidewall lip. The lid inner shell may comprise a lid inner shell sidewall having a lid inner shell sidewall first end, a lid inner shell sidewall second end, and a lid inner shell exterior profile. The lid inner shell first end wall is attached to the lid inner shell sidewall first end. The lid inner shell sidewall lip may be located at the lid inner shell sidewall second end.

The base comprises at least a base inner shell and a base inner shell second end wall. The base inner shell may comprise a base inner shell sidewall first end, a base inner shell sidewall second end, and a base inner shell exterior profile. The base inner shell second end wall is attached to the base inner shell sidewall second end.

The lid inner shell sidewall and lid first end wall define a first tobacco can chamber section. Similarly, the base inner shell sidewall and the base second end wall define a second tobacco can chamber section. The first tobacco can chamber section and second tobacco can chamber section define a tobacco can chamber when the lid is engaged with the base.

The lid will comprise a lid outer shell and/or the base will comprise a base outer shell. When present, the lid outer shell may comprise a lid outer shell sidewall and a lid outer shell first end wall. The lid outer shell sidewall may have a lid outer shell sidewall first end, a lid outer shell sidewall second end, and a lid outer shell exterior profile. The lid outer shell first end wall may be attached to the lid outer shell sidewall first end.

When present, the base outer shell may comprise a base outer shell sidewall, a base outer shell second end wall, and a base outer shell sidewall lip. The base outer shell sidewall may have a base outer shell sidewall first end, a base outer shell sidewall second end, and a base outer shell exterior profile. The base outer shell second end wall may be attached to the base outer shell sidewall second end. The base outer shell sidewall lip may be located at the base outer shell sidewall first end.

A portion of a first interior surface of the lid outer shell sidewall may be sealed to a portion of a first exterior surface of the lid inner shell sidewall when the lid outer shell is present. Such sealing, when present, may form a lid void. In some embodiments, a first pressure within the lid void may be less than 1 atm.

A portion of a second interior surface of the base outer shell sidewall may be sealed to a portion of a second exterior surface of the base inner shell sidewall when the base outer shell is present. Such sealing, when present, may form a base void. In some embodiments, a second pressure within the base void may be less than 1 atm.

In certain embodiments, at least one of the lid inner shell, the lid outer shell, the base inner shell, and/or the base outer shell may be comprised of a material having a thermal conductivity in a range of between 10 W/m K and 200 W/m K.

In some embodiments, the lid void may comprise a first cooling media. In some such embodiments, the first cooling media may comprise a gelatinous material having a freezing point below 0° C. sealed within a flexible polymer encasement.

In certain embodiments, the base void may comprise a second cooling media. In certain such embodiments, the second cooling media may comprise a gelatinous material having a freezing point below 0° C. sealed within a flexible polymer material.

Some embodiments of the tobacco can cooler may further comprise a gasket. When present, the gasket may be located at an interface between the lid and the base when the lid is engaged with the base.

In certain embodiments, the lid may be configured to engage with the base by a tongue and groove mechanism. In other embodiments, the lid may be configured to engage with the base by screwing the lid onto the base. In still other embodiments, the lid may be configured to engage with the base by a twist lock mechanism.

In some embodiments, the lid inner shell exterior profile, the lid outer shell exterior profile, the base inner shell exterior profile, and the base outer shell exterior profile may each independently have a shape selected from the group consisting of cylindrical, ovular, triangular, quadrilateral, heptagonal, hexagonal, and octagonal. In certain such embodiments, the shape of each of the lid inner shell exterior profile, the lid outer shell exterior profile, the base inner shell exterior profile, and the base outer shell exterior profile may each be the same. In some embodiments, the shape of each of the lid inner shell exterior profile, the lid outer shell exterior profile, the base inner shell exterior profile, and the base outer shell exterior profile may each be the same as a second shape of a tobacco can.

In certain embodiments, the portion of the first interior surface the lid outer shell sidewall may be sealed to the portion of a first exterior surface of the lid inner shell sidewall by welding, bonding with an adhesive, manufacturing the base outer shell and the base inner shell of a single integral piece of material, an interference fit, and combinations thereof. Similarly, in some embodiments, the portion of the second interior surface of the base outer shell sidewall may be sealed to the portion of the second exterior surface of the base inner shell sidewall by welding, bonding with an adhesive, manufacturing the base outer shell and the base inner shell of a single integral piece of material, an interference fit, and combinations thereof.

DETAILED DESCRIPTION

Disclosed herein is a tobacco can cooler. The tobacco can cooler is described below with reference to the Figures. As described herein and in the claims, the following numbers refer to the following structures as noted in the Figures.

5 refers to a tobacco can.
10 refers to a tobacco can cooler.
100 refers to a lid.
110 refers to a lid inner shell.
111 refers to a lid inner shell sidewall.
112 refers to a lid inner shell sidewall first end.
113 refers to a lid inner shell sidewall second end.
114 refers to a lid inner shell exterior profile.
115 refers to a lid inner shell first end wall.
116 refers to a lid inner shell sidewall lip.
117 refers to a first exterior surface (of the lid inner shell sidewall).
120 refers to a lid outer shell.
121 refers to a lid outer shell sidewall.
122 refers to a lid outer shell sidewall first end.
123 refers to a lid outer shell sidewall second end.
124 refers to a lid outer shell exterior profile.
125 refers to a lid outer shell first end wall.
126 refers to a first interior surface (of the lid outer shell sidewall).
130 refers to a lid void.
200 refers to a base.
210 refers to a base inner shell.
211 refers to a base inner shell sidewall.
212 refers to a base inner shell sidewall first end.
213 refers to a base inner shell sidewall second end.
214 refers to a base inner shell exterior profile.
215 refers to a base inner shell second end wall.
216 refers to a second exterior surface (of the base inner shell sidewall).
220 refers to a base outer shell.
221 refers to a base outer shell sidewall.
222 refers to a base outer shell sidewall first end.
223 refers to a base outer shell sidewall second end.
224 refers to a base outer shell exterior profile.
225 refers to a base outer shell second end wall.
226 refers to a base outer shell sidewall lip.
227 refers to a second interior surface (of the base outer shell sidewall).
230 refers to a base void.
300 refers to a tobacco can chamber.
310 refers to a first tobacco can chamber section.
320 refers to a second tobacco can chamber section.
400 refers to a first cooling media.
410 refers to a second cooling media.
500 refers to a gasket.

Figure 1:
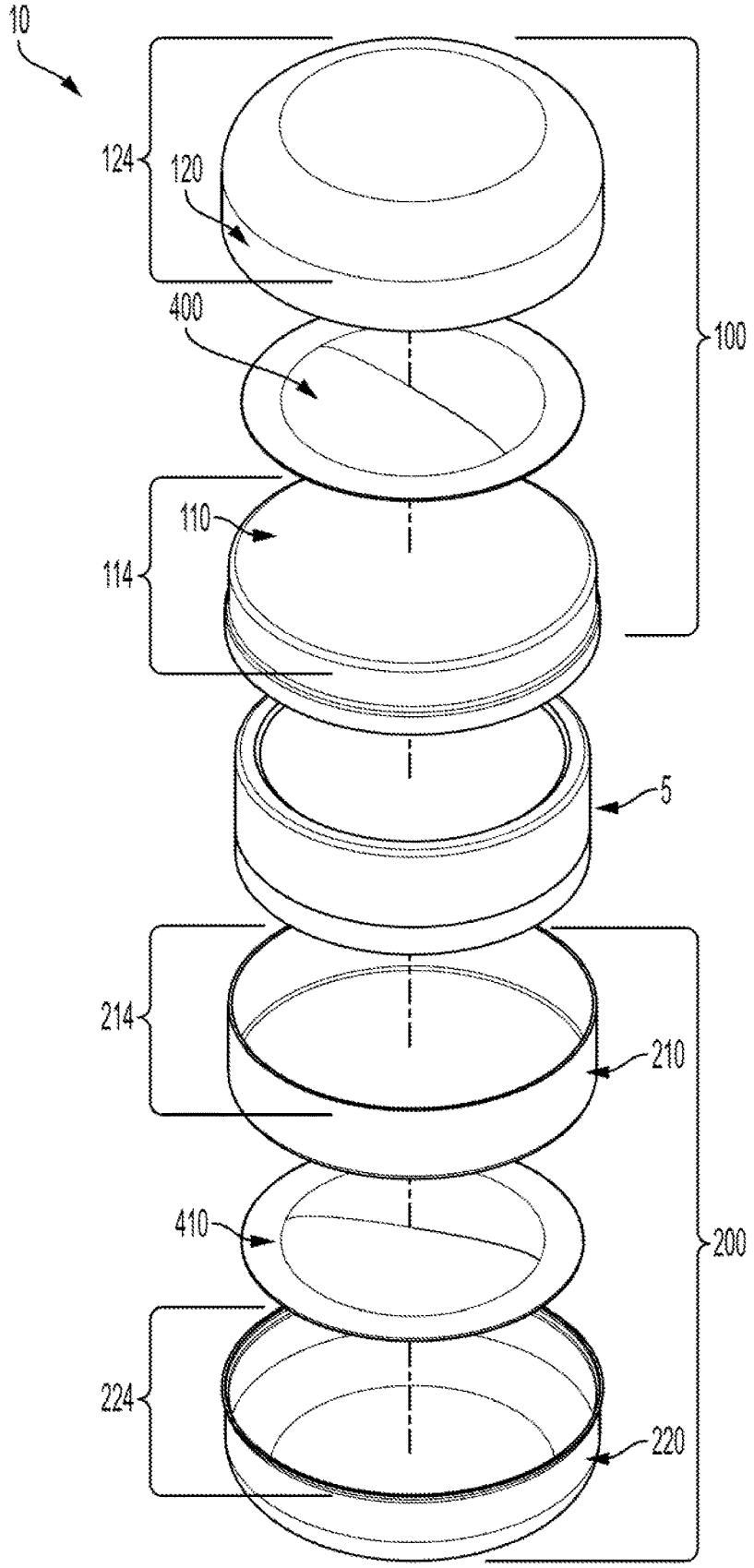
FIG. 1 is an exploded perspective view of an embodiment of a tobacco can cooler.

FIG. 1 shows an exploded view of an embodiment of a tobacco can cooler (10). As shown in FIG. 1, the tobacco can cooler comprises a lid (100) and a base (200). In the embodiment shown in FIG. 1 each of the lid and the base comprises a double walled configuration formed by joining an inner shell to an outer shell as described herein. While the double walled configuration is preferred for both the lid and the base, embodiments may exist—such as those shown in FIG. 6 and FIG. 7 and described herein—in which either the lid or the base has a single walled configuration without the outer shell.

Specific to the lid (100), FIG. 1 shows the double wall configuration with the lid comprising a lid inner shell (110) and a lid outer shell (120). As shown in FIG. 1, the lid inner shell has a lid inner shell exterior profile (114). Similarly, the lid outer shell has a lid outer shell exterior profile (124). While FIG. 1 shows the lid inner shell exterior profile and lid outer shell exterior profile having a cylindrical shape, other shapes are possible including an ovular, triangular, quadrilateral, heptagonal, hexagonal, or octagonal shape. Preferably, the shape of the lid inner shell exterior profile will be substantially similar or identical to that of the tobacco can (5) which is intended to be housed within the tobacco can cooler (10) as described herein. While the lid inner shell exterior profile and the lid outer shell exterior profile will have the same shape in most embodiments, embodiments may exist in which the lid inner shell exterior profile is different from that of the lid outer shell exterior profile.

FIG. 1 also shows the double wall configuration of the base (200) with the base comprising a base inner shell (210) and a base outer shell (220). As shown in FIG. 1, the base inner shell has a base inner shell exterior profile (214). Similarly, the base outer shell has a base outer shell exterior profile (224). While FIG. 1 shows the base inner shell exterior profile and base outer shell exterior profile having a cylindrical shape, other shapes are possible including an ovular, triangular, quadrilateral, heptagonal, hexagonal, or octagonal shape. Preferably the shape of the base inner shell exterior profile will be substantially similar or identical to that of the tobacco can (5) which is intended to be housed within the tobacco can cooler (10) as described herein. While the base inner shell exterior profile and the base outer shell exterior profile will have the same shape in most embodiments, embodiments may exist in which the base inner shell exterior profile is different from that of the base outer shell exterior profile.

At least one—preferably each—of the lid inner shell (110), the (optional) lid outer shell (120), the base inner shell (210), and the (optional) base outer shell (220) will be comprised of a material having a thermal conductivity. The thermal conductivity of such material may be in a range selected from the group consisting of between 10 W/m K and 200 W/m K, between 10 W/m K and 150 W/m K, between 10 W/m K and 100 W/m K, between 10 W/m K and 50 W/m K, between 50 W/m K and 200 W/m K, between 50 W/m K and 150 W/m K, between 50 W/m K and 100 W/m K, between 100 W/m K and 200 W/m K, between 100 W/m K and 150 W/m K, and between 150 W/m K and 200 W/m K. Non-limiting examples of such materials include stainless steel, carbon steel, chrome steel, nickel, titanium, and cast iron.

FIG. 1 also shows a plurality of (optional) cooling media comprising a first cooling media (400) and a second cooling media (410). When present, the first cooling media corresponds to the lid (100) while the second cooling media—when present—corresponds to the base (200). The specific location and configuration of the cooling media—when present—will be described herein with reference to FIG. 4 in particular. While many different types of cooling media may be utilized, the preferred cooling media is a gelatinous material having a freezing point below 0° C. sealed within a flexible polymer encasement—sometimes referred to as a gel refrigerant. Preferable gelatinous materials include alcohol based gelatinous materials and glycol based gelatinous materials. Specific non-limiting examples of such gelatinous materials include gelatinous diethylene glycol, gelatinous ethylene glycol, gelatinous hydroxyethyl cellulose, gelatinous sodium polyacrylate, and gelatinous vinyl-coated silica gel. Non-limiting examples of such flexible polymer encasements include the polyesters, polyamides, and the like.

Figure 2:
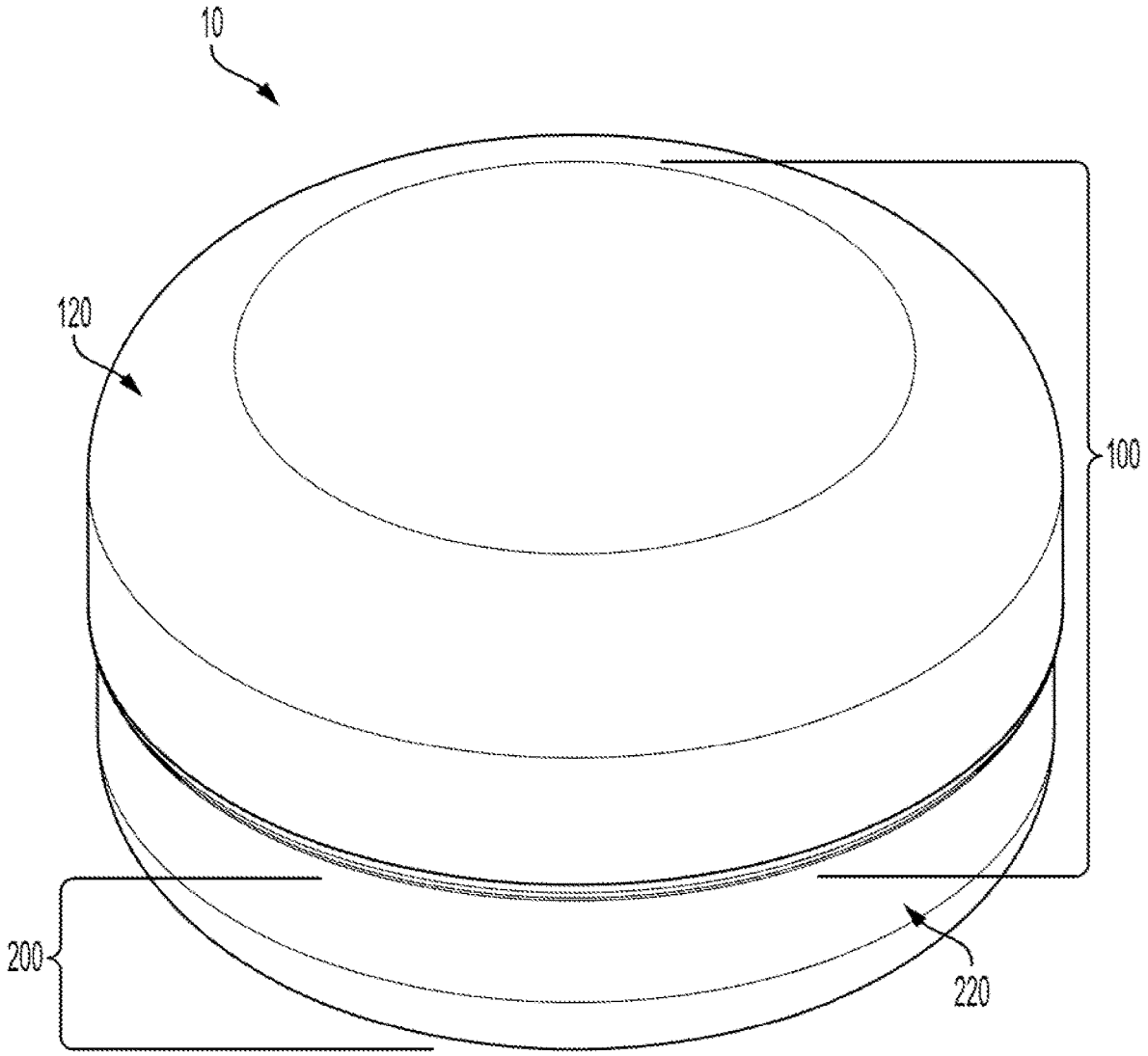
FIG. 2 is an assembled perspective view of the embodiment of a tobacco can cooler of FIG. 1.
Figure 4:
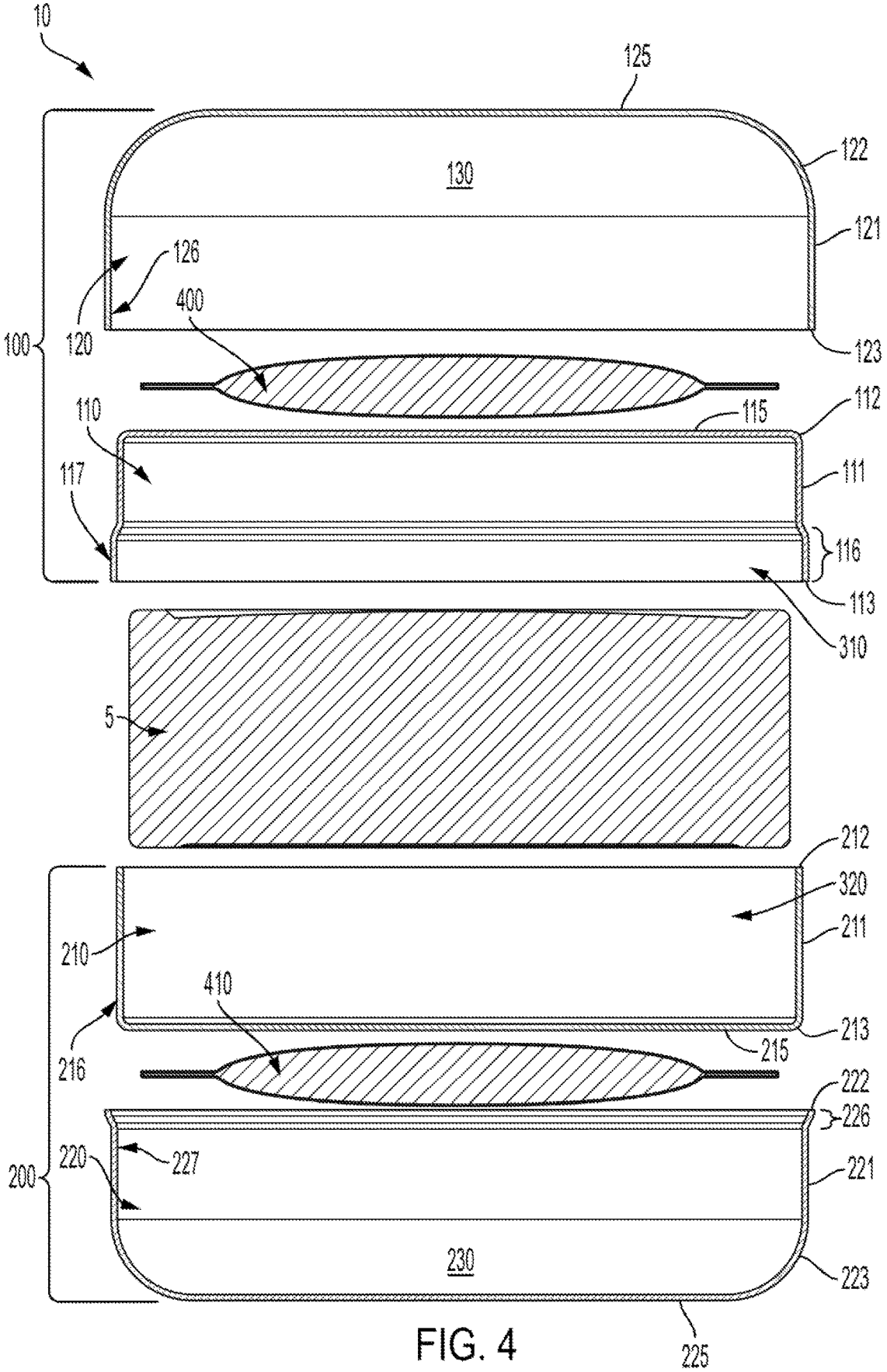
FIG. 4 is an exploded side cross-sectional view of the embodiment of a tobacco can cooler of FIG. 3.

FIG. 2 shows the embodiment of a tobacco can cooler (10) of FIG. 1 in assembled form. As shown in FIG. 2, when assembled, the lid (100) is engaged with the base (200). The engagement between the lid and the base may take many forms. In the simplest form, the lid is configured with an interior radial cross-sectional profile which is slightly larger than an exterior radial cross-sectional profile of the base. In such a configuration, at least a portion of the lid inner shell sidewall (111 as shown in FIG. 4) fits over and encompasses at least a portion of the base outer shell sidewall (221 as shown in FIG. 4). This configuration can easily be reversed such that the lid is configured with an exterior radial cross-sectional profile which is slightly smaller than an interior radial cross-sectional profile of the base. In such a configuration, at least a portion of the base inner shell sidewall (211 as shown in FIG. 4) fits over and encompasses at least a portion of the lid outer shell sidewall (121 as shown in FIG. 4). In either embodiment, friction between the two sidewalls may removably engage the lid with the base.

In some embodiments, the lid (100) may be configured to engage with the base (200)—at least in part—by using a tongue and grove mechanism. In other embodiments, the lid may be configured to engage with the base—at least in part—by screwing the lid onto the base. In still other embodiments, the lid may be configured to engage with the base—at least in part—by using a twist lock mechanism.

Figure 3:
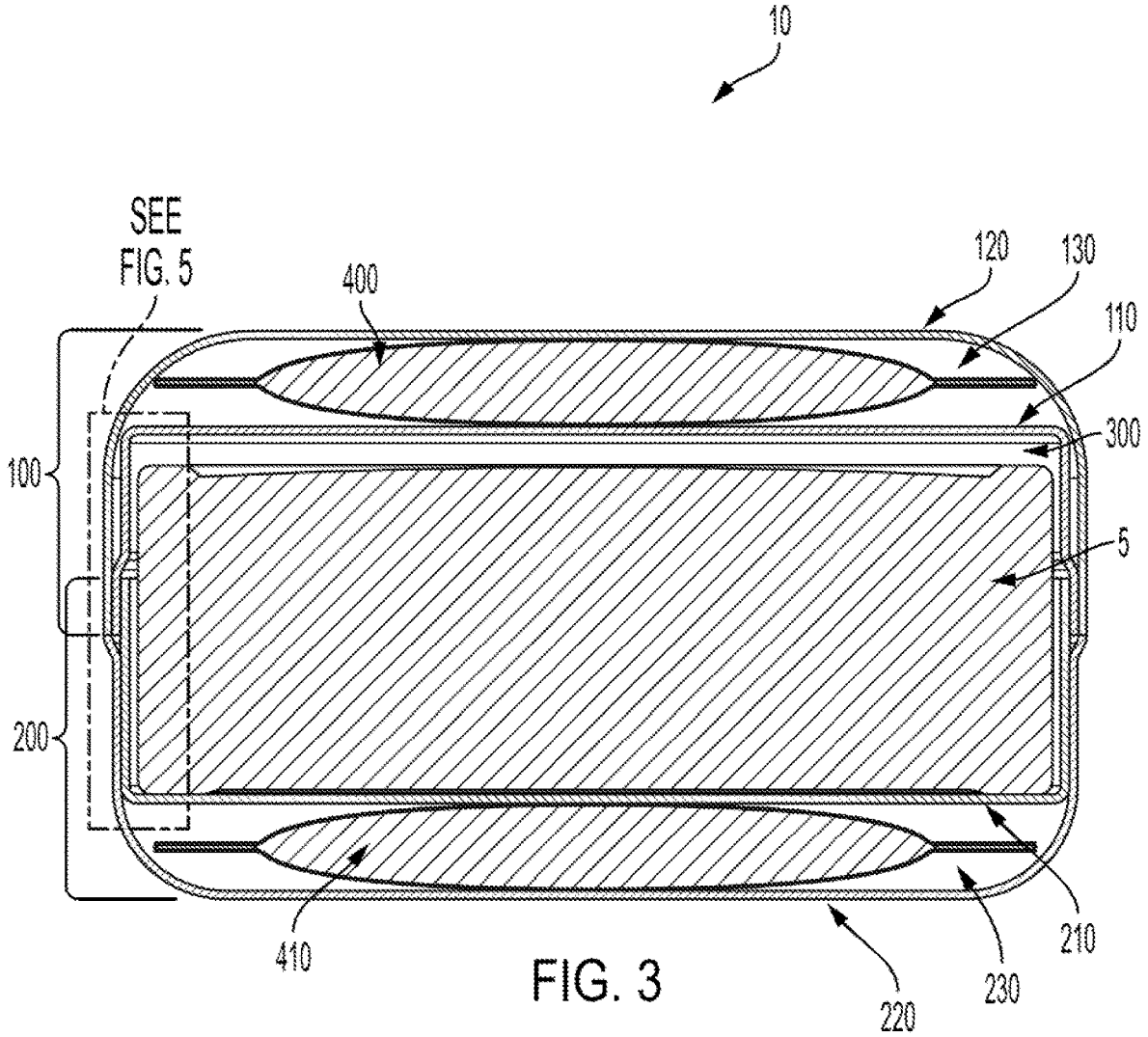
FIG. 3 is a side cross-sectional view of an embodiment of a tobacco can cooler.

FIG. 3 and FIG. 4 shows assembled (FIG. 3) and exploded (FIG. 4) views of an embodiment of a tobacco can cooler (10) in axial cross section. The axial cross section views shown in FIG. 3 and FIG. 4 include additional details of the lid (100), and the base (200).

As shown in FIG. 4, the lid (100) comprises at least a lid inner shell (110). The lid inner shell may comprise a lid inner shell sidewall (111), a lid inner shell first end wall (115), and a lid inner shell sidewall lip (116). In the embodiment shown in FIG. 4, the lid inner shell has a cylindrical shaped lid inner shell exterior profile (114 as shown in FIG. 1). However, as discussed herein with respect to FIG. 1, other shapes may be utilized for the lid inner shell exterior profile.

The lid inner shell sidewall (111) will have a lid inner shell sidewall first end (112) and a lid inner shell sidewall second end (113) with the lid inner shell sidewall second end opposite the lid inner shell sidewall first end as shown in FIG. 4. Attached to the lid inner shell sidewall first end will be the lid inner shell first end wall (115). This results in the lid inner shell (110) being closed at the lid inner shell sidewall first end and open at the lid inner shell sidewall second end.

The lid inner shell sidewall lip (116) may originate at the lid inner shell sidewall second end (113) and extend up a portion of the lid inner shell sidewall (111) terminating before the lid inner shell sidewall first end. Preferably the lid inner shell sidewall lip will extend outwardly in the radial direction such that the lid inner shell sidewall has a first diameter measured at the lid inner shell sidewall second end which is greater than a second diameter measured at the lid inner shell sidewall first end.

In some embodiments, the lid (100) may also comprise a lid outer shell (120). As shown in FIG. 4, the lid outer shell may comprise a lid outer shell sidewall (121) and a lid outer shell first end wall (125). In the embodiment shown in FIG. 4, the lid outer shell has a cylindrical shaped lid outer shell exterior profile (124 as shown in FIG. 1). However, as discussed herein with respect to FIG. 1, other shapes may be utilized for the lid outer shell exterior profile.

The lid outer shell sidewall (121)—when present—will have a lid outer shell sidewall first end (122) and a lid outer shell sidewall second end (123) with the lid outer shell sidewall second end opposite the lid outer shell sidewall first end as shown in FIG. 4. Attached to the lid outer shell sidewall first end will be the lid outer shell first end wall (125). This results in the lid outer shell (120) being closed at the lid outer shell sidewall first end and open at the lid outer shell sidewall second end.

When the lid outer shell (120) is present, a portion of a first interior surface (126 as shown in FIG. 4) of the lid outer shell sidewall may be sealed to a portion of a first exterior surface (117 as shown in FIG. 4) of the lid inner shell sidewall as shown in FIG. 3. This forms a lid void (130) between the lid inner shell first end wall (115) and the lid outer shell first end wall (125) as shown in FIG. 3. The lid void may contain, comprise, or encompass the first cooling media (400)—when present.

Optional sealing of the first interior surface (126) of the lid outer shell sidewall to the first exterior surface (117) of the lid inner shell sidewall may be accomplished in a variety of ways. Non-limiting examples of methods for sealing the first interior surface of the lid outer shell sidewall to the first exterior surface of the lid inner shell sidewall include welding, bonding with an adhesive, manufacturing the lid outer shell and the lid inner shell of a single integral piece of material, and an interference fit (as described herein).

As shown in FIG. 4, the base (200) comprises at least a base inner shell (210). The base inner shell may comprise a base inner shell sidewall (211) and a base inner shell second end wall (215). In the embodiment shown in FIG. 4, the base inner shell has a cylindrical shaped base inner shell exterior profile (214 as shown in FIG. 1). However, as discussed herein with respect to FIG. 1, other shapes may be utilized for the base inner shell exterior profile.

The base inner shell sidewall (211) will have a base inner shell sidewall first end (212) and a base inner shell sidewall second end (213) with the base inner shell sidewall second end opposite the base inner shell sidewall first end as shown in FIG. 4. Attached to the base inner shell sidewall second end will be the base inner shell second end wall (215). This results in the base inner shell (210) being closed at the base inner shell sidewall second end and open at the base inner shell sidewall first end.

In some embodiments, the base (200) may also comprise a base outer shell (220). As shown in FIG. 4, the base outer shell may comprise a base outer shell sidewall (221), a base outer shell second end wall (225), and a base outer shell sidewall lip (226). In the embodiment shown in FIG. 4, the base outer shell has a cylindrical shaped base outer shell exterior profile (224 as shown in FIG. 1). However, as discussed herein with respect to FIG. 1, other shapes may be utilized for the base outer shell exterior profile.

The base outer shell sidewall (221)—when present—will have a base outer shell sidewall first end (222) and a base outer shell sidewall second end (223) with the base outer shell sidewall second end opposite the base outer shell sidewall first end as shown in FIG. 4. Attached to the base outer shell sidewall first end will be the base outer shell second end wall (225). This results in the base outer shell (220) being closed at the base outer shell sidewall first end and open at the base outer shell sidewall second end.

When present, the base outer shell sidewall lip (226) may originate at the base outer shell sidewall first end (222) and extend down a portion of the base outer shell sidewall (221) terminating before the base outer shell sidewall second end (223). Preferably the base outer shell sidewall lip will extend outwardly in the radial direction such that the base outer shell sidewall has a first diameter measured at the base outer shell sidewall first end which is greater than a second diameter measured at the base outer shell sidewall second end.

When the base outer shell (220) is present, a portion of a second interior surface (227 as shown in FIG. 4) of the base outer shell sidewall may be sealed to a portion of a second exterior surface (216 as shown in FIG. 4) of the base inner shell sidewall as shown in FIG. 3. This forms a base void (230) between the base inner shell second end wall (215) and the base outer shell second end wall (225) as shown in FIG. 3. The base void may contain, comprise, or encompass the second cooling media (410)—when present.

Optional sealing of the second interior surface (216) of the base inner shell sidewall to the second exterior surface (227) of the base outer shell sidewall may be accomplished in a variety of ways. Non-limiting examples of methods for sealing the second interior surface of the base outer shell sidewall to the second exterior surface of the base inner shell sidewall include welding, bonding with an adhesive, manufacturing the base outer shell and the base inner shell of a single integral piece of material, and an interference fit (as described herein).

As shown in FIG. 4, the lid inner shell sidewall (111) and the lid first end wall (115) define a first tobacco can chamber section (310). Similarly, the base inner shell sidewall (211) and the base second end wall (215) define a second tobacco can chamber section (320). When the tobacco can cooler (10) is assembled by engaging the lid with the base as shown in FIG. 3, the first tobacco can chamber section and second tobacco can chamber section combine to form a tobacco can chamber (300). A tobacco can (5 as shown in FIG. 4) may reside within the tobacco can chamber with a first portion of the tobacco can located within the first tobacco can chamber section and a second portion of the tobacco can located within the second tobacco can chamber section.

Figure 5:
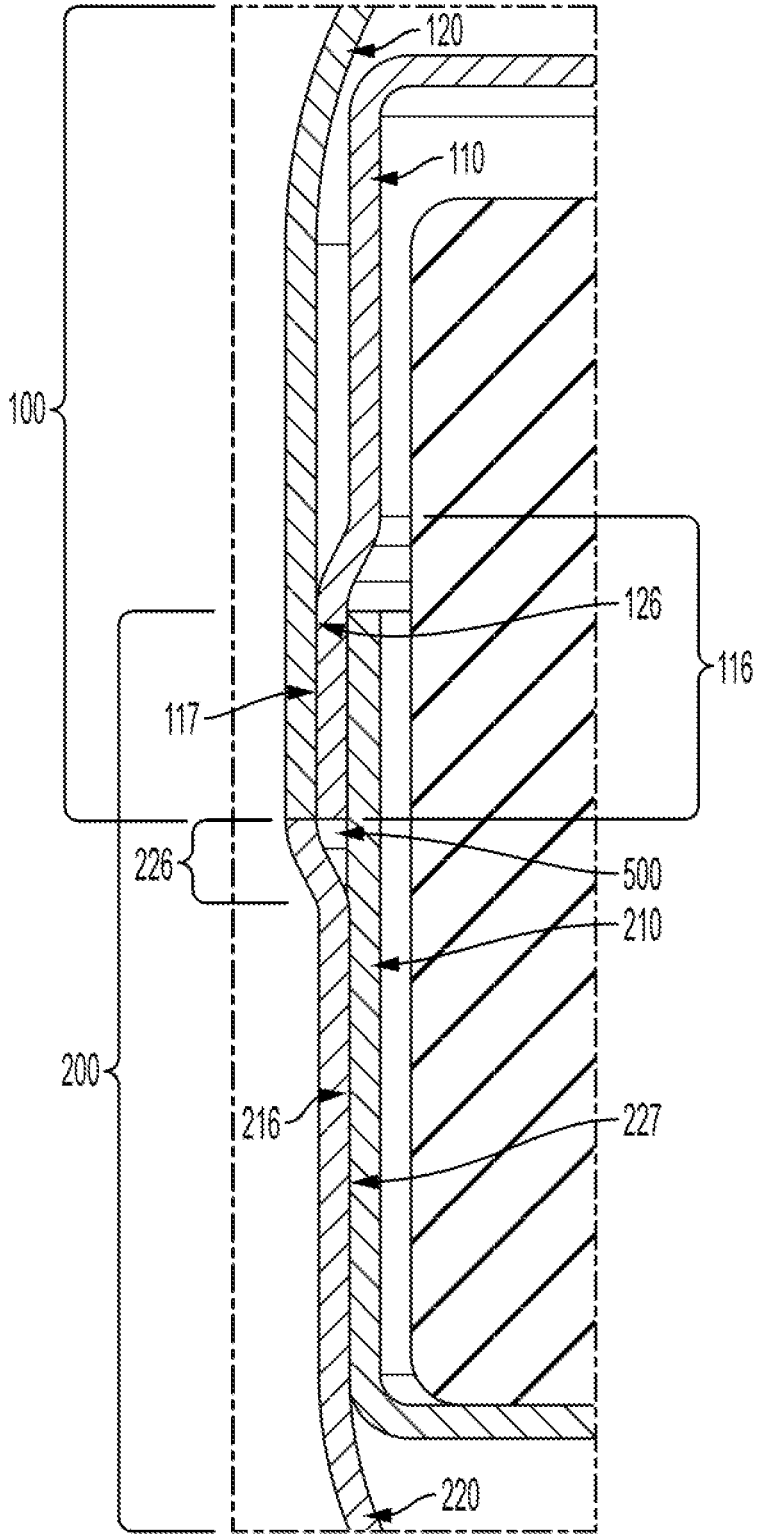
FIG. 5 is a side cross-sectional view of the interface between a lid and a base of a tobacco can cooler.

FIG. 5 shows a side cross-sectional view of the interface between a lid (100) and a base (200) of an embodiment of a tobacco can cooler (10). In the embodiment shown in FIG. 5, the lid comprises both a lid inner shell (110) and a lid outer shell (120). Similarly, in the embodiment shown in FIG. 5, the base comprises both a base inner shell (210) and a base outer shell (220).

As shown in FIG. 5, when the lid outer shell (120) is present, a portion of a first interior surface (126) of the lid outer shell sidewall may be sealed to a portion of a first exterior surface (117) of the lid inner shell sidewall. Preferably the portion of the first exterior surface of the lid inner shell sidewall is located at the lid inner shell sidewall lip (116). Optional sealing of the first interior surface of the lid outer shell sidewall to the first exterior surface of the lid outer shell sidewall may be accomplished by any number of techniques non-limiting examples of which include welding, bonding with an adhesive such as an epoxy adhesive, and manufacturing the lid outer shell and the lid inner shell (110) of a single integral piece of material.

One preferred method for optional sealing of the first interior surface (126) of the lid outer shell sidewall (121) to the first exterior surface (117) of the lid outer shell sidewall (111) is an interference fit whereby the lid outer shell (120) is heated to thermally expand the dimension of the lid outer shell exterior profile (124 as shown in FIG. 1) while the lid inner shell (110) is cooled to thermally contract the dimension of the lid inner shell exterior profile (114 as shown in FIG. 1). The lid inner shell is then placed within the interior of the lid outer shell and aligned as shown in the Figures. The two components are then allowed to return to room temperature-returning the dimension of their exterior profiles to approximately their original dimensions whereby the first exterior surface of the lid inner shell sidewall frictionally engages with the first interior surface of the lid outer shell sidewall.

Optional sealing of the first interior surface (126) of the lid outer shell sidewall to the first exterior surface (117) of the lid inner shell sidewall—in part—forms the lid void (130). In preferred embodiments, a first pressure within the lid void may be in a range selected from the group consisting of less than 1.0 atm, less than 0.75 atm, less than 0.5 atm, less than 0.25 atm, and less than 0.1 atm. The pressure within the lid void may be accomplished by applying a vacuum condition to the lid void during formation of the seal between lid outer shell sidewall (121) and the lid inner shell sidewall (111). In embodiments where sealing between the lid outer shell sidewall and the lid inner shell sidewall occurs as an interference fit, the vacuum condition may be accomplished by forming the interference fit as described herein within a vacuum chamber.

FIG. 5 also shows that, when the base outer shell (220) is present, a portion of a second interior surface (227) of the base outer shell sidewall may be sealed to a portion of a second exterior surface (216) of the base inner shell sidewall. Optional sealing of the second interior surface of the base outer shell sidewall to the second exterior surface of the base outer shell sidewall may be accomplished by any number of techniques non-limiting examples of which include welding, bonding with an adhesive such as an epoxy adhesive, and manufacturing the base outer shell and the base inner shell (210) of a single integral piece of material.

One preferred method for optional sealing of the second interior surface (227) of the base outer shell sidewall (221) to the second exterior surface (216) of the base outer shell sidewall (211) is an interference fit whereby the base outer shell (220) is heated to thermally expand the dimension of the base outer shell exterior profile (224 as shown in FIG. 1) while the base inner shell (210) is cooled to thermally contract the dimension of the base inner shell exterior profile (214 as shown in FIG. 1). The base inner shell is then placed within the interior of the base outer shell and aligned as shown in the Figures. The two components are then allowed to return to room temperature—returning the dimension of their exterior profiles to approximately their original dimensions whereby the second exterior surface of the base inner shell sidewall frictionally engages with the second interior surface of the base outer shell sidewall.

Optional sealing of the second interior surface (227) of the base outer shell sidewall to the second exterior surface (216) of the base inner shell sidewall—in part—forms the base void (230). In preferred embodiments, a second pressure within the base void may be in a range selected from the group consisting of less than 1.0 atm, less than 0.75 atm, less than 0.5 atm, less than 0.25 atm, and less than 0.1 atm. The pressure within the base void may be accomplished by applying a vacuum condition to the base void during formation of the seal between base outer shell sidewall (221) and the base inner shell sidewall (211). In embodiments where sealing between the base outer shell sidewall and the base inner shell sidewall occurs as an interference fit, the vacuum condition may be accomplished by forming the interference fit as described herein within a vacuum chamber.

The lid (100) may be engaged with the base (200) to form the tobacco can cooler (10) by passing at least a portion of the lid sidewall over the base sidewall as shown in FIG. 5. To maintain the engagement between the lid and the base during normal storage operations, it is preferred that the interior dimensions of the lid sidewall be slightly greater than the exterior dimensions of the base sidewall. By slightly greater it is meant that the interior dimension of the lid sidewall is no more than 2.0% greater than the exterior dimension of the base sidewall with no more than 1.5% greater being preferred, no more than 1.0% greater being even more preferred, no more than 0.5% greater being still more preferred, and no more than 0.1% greater being most preferred. For example, when the lid and the base each have an exterior profile having a cylindrical shape with the base having an exterior diameter of 10 cm, the lid may have an interior diameter in the range of between 10.01 cm and 10.2 cm.

One of ordinary skill will recognize that, while FIG. 5 shows the lid (100) engaged with the base (100) by passing at least a portion of the lid sidewall over the base sidewall, the configuration may be easily reversed. That is to say that, in some embodiments, the lid may engage with the base by passing at least a portion of the base sidewall over the lid sidewall. In such embodiments, to maintain the engagement between the lid and the base during normal storage operations, it is preferred that the interior dimensions of the base sidewall be slightly greater than the exterior dimensions of the lid sidewall. By slightly greater it is meant that the interior dimension of the base sidewall is no more than 2.0% greater than the exterior dimension of the lid sidewall with no more than 1.5% greater being preferred, no more than 1.0% greater being even more preferred, no more than 0.5% greater being still more preferred, and no more than 0.1% greater being most preferred. For example, when the lid and the base each have an exterior profile having a cylindrical shape with the lid having an exterior diameter of 10 cm, the base may have an interior diameter in the range of between 10.01 cm and 10.2 cm.

Also shown in FIG. 5 is an optional gasket (500) located at an interface between the lid (100) and the base (200). When present, the gasket may be utilized to provide a sealing force between the lid and the base and to reduce thermal loss within the tobacco can chamber (300 as shown in FIG. 3). When assembled, the gasket may be bounded by the lid inner shell sidewall second end (113 as shown in FIG. 4), the base outer shell sidewall lip (226), and a portion of the exterior surface of the base inner shell sidewall (211 as shown in FIG. 4) proximate the base inner shell sidewall first end (212 as shown in FIG. 4). The gasket may be comprised of any number of materials commonly used in the art for creating gaskets. Non-limiting examples of such materials include rubbers, flexible polymers, cork, and the like.

Figure 6:
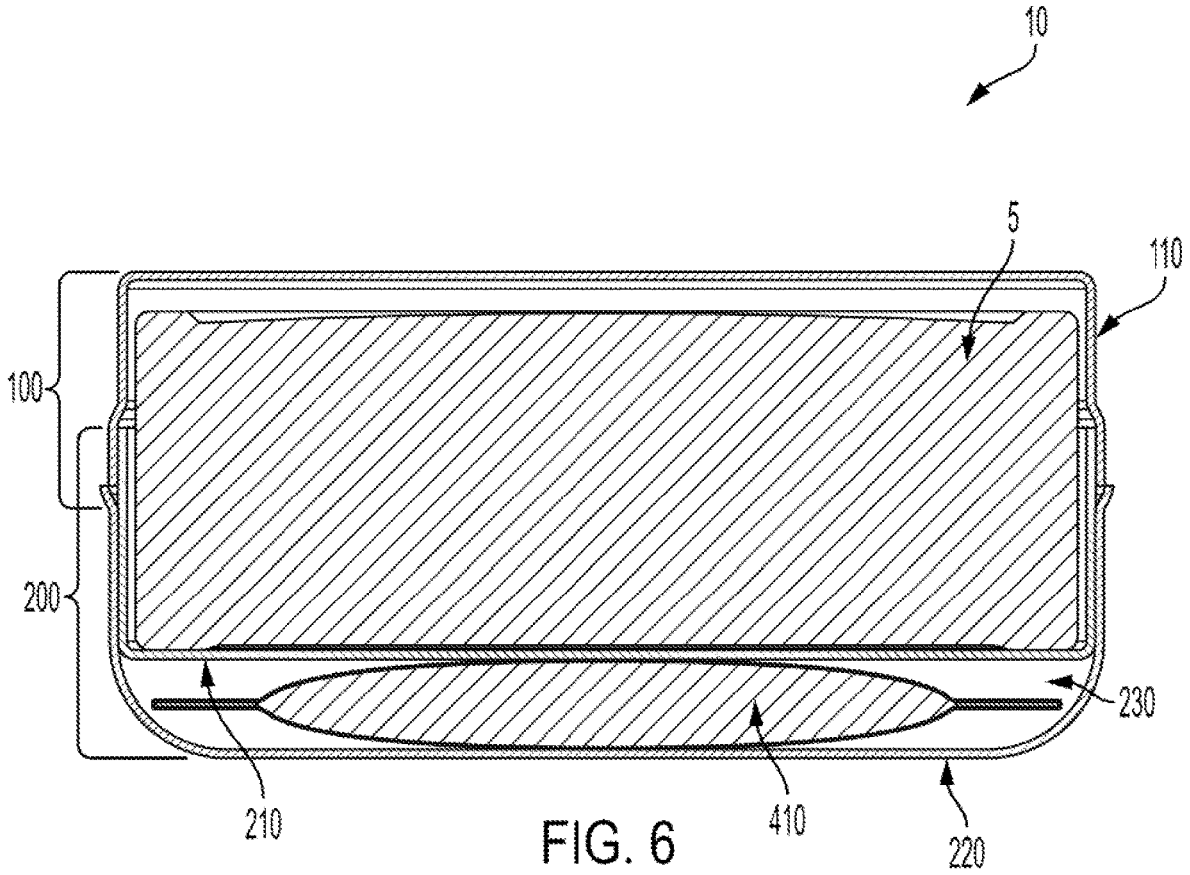
FIG. 6 is a side cross-sectional view of an alternative embodiment of a tobacco can cooler.

FIG. 6 shows an alternative embodiment of a tobacco can cooler (10) in which the lid outer shell is not present. As shown in FIG. 6, in some embodiments, the lid (100) will comprise only a lid inner shell (110) while the base (200) will comprise both a base inner shell (210) and a base outer shell (220). In such embodiments, there may be only a single optional cooling media which in this case is labelled as the second cooling media (410) which is present in the base void (230).

Figure 7:
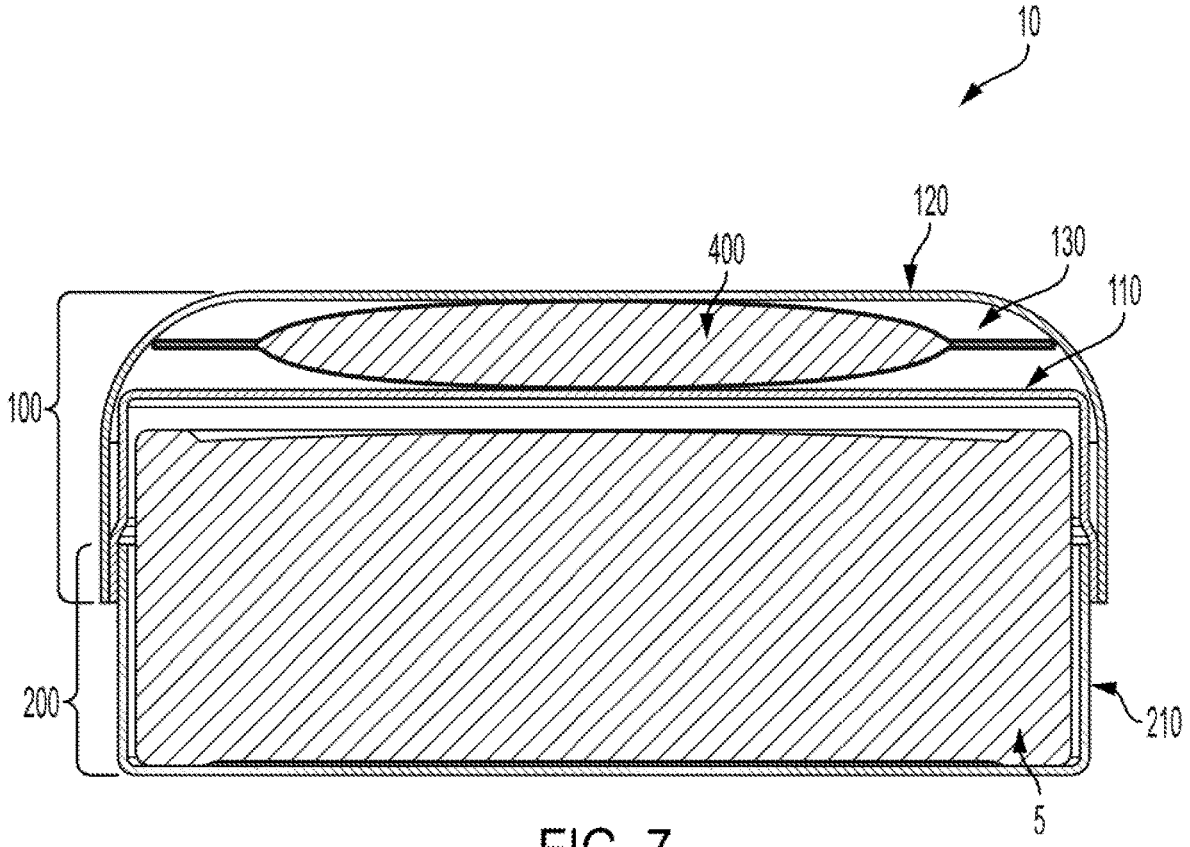
FIG. 7 is a side cross-sectional view of an alternative embodiment of a tobacco can cooler.

Alternatively, FIG. 7 shows an embodiment of a tobacco can cooler (10) in which the base outer shell is not present. As shown in FIG. 7, in some embodiments, the base (200) will comprise only a base inner shell (210) while the lid (100) will comprise both a lid inner shell (110) and a lid outer shell (120). In such embodiments, there may be only a single optional cooling media which in this case is labelled as the first cooling media (400) which is present in the lid void (130).

As shown in the Figures, the tobacco can (5) can be stored within the tobacco can chamber (300) of the tobacco can cooler (10). Preferably, the tobacco can will be placed in the cooler after a period of time of storing one or both of the lid (100) and/or the base (200) in an environment such as a refrigerator, freezer, or a supply of ice that reduces the temperature of the lid, the base, the optional first cooling media (400), and/or the optional second cooling media (410). Thermal transfer then assists in reducing or preventing increased temperatures within the tobacco can caused by storing the tobacco can on one's person. By reducing or preventing such increased temperatures the smokeless tobacco product within the tobacco can remains fresh for a longer period of time and is less prone to spoliation.

While the invention has been described as having exemplary designs, the present invention may be further modified within the spirit and scope of this disclosure. This application is therefore intended to cover any variations, uses, or adaptations of the invention using its general principles.

What is claimed is:

1. A tobacco can cooler comprising: a lid comprising a lid inner shell comprising: a lid inner shell sidewall having a lid inner shell sidewall first end, a lid inner shell sidewall second end, and a lid inner shell exterior profile; a lid inner shell first end wall attached to the lid inner shell sidewall first end; and a lid inner shell sidewall lip at the lid inner shell sidewall second end; a base comprising a base inner shell comprising: a base inner shell sidewall having a base inner shell sidewall first end, a base inner shell sidewall second end, and a base inner shell exterior profile; and a base inner shell second end wall attached to the base inner shell sidewall second end; and wherein the lid inner shell sidewall and lid first end wall define a first tobacco can chamber section, the base inner shell sidewall and base second end wall define a second tobacco can chamber section, and the first tobacco can chamber section and second tobacco can chamber section define a tobacco can chamber when the lid is engaged with the base, and wherein: the lid comprises a lid outer shell comprising: a lid outer shell sidewall having a lid outer shell sidewall first end, a lid outer shell sidewall second end, and a lid outer shell exterior profile; and a lid outer shell first end wall attached to the lid outer shell sidewall first end; and/or the base comprises a base outer shell comprising: a base outer shell sidewall having a base outer shell sidewall first end, a base outer shell sidewall second end, and a base outer shell exterior profile; a base outer shell second end wall attached to the base outer shell sidewall second end; and a base outer shell sidewall lip at the base outer shell sidewall first end.

2. The tobacco can cooler of claim 1, wherein at least one of the lid inner shell, the lid outer shell, the base inner shell, and/or the base outer shell is comprised of a material having a thermal conductivity in a range of between 10 W/m K and 200 W/m K.

3. The tobacco can cooler of claim 1, wherein a portion of a first interior surface of the lid outer shell sidewall is sealed to a portion of a first exterior surface of the lid inner shell sidewall when the lid outer shell is present forming a lid void.

4. The tobacco can cooler of claim 3, wherein a first pressure within the lid void is less than 1 atm.

5. The tobacco can cooler of claim 3, wherein the lid void comprises a first cooling media.

6. The tobacco can cooler of claim 5, wherein the first cooling media comprises a gelatinous material having a freezing point below 0° C. sealed within a flexible polymer encasement.

7. The tobacco can cooler of claim 1, wherein a portion of a second interior surface of the base outer shell sidewall is sealed to a portion of a second exterior surface of the base inner shell sidewall when the base outer shell is present forming a base void.

8. The tobacco can cooler of claim 7, wherein a second pressure within the base void is less than 1 atm.

9. The tobacco can cooler of claim 7, wherein the base void comprises a second cooling media.

10. The tobacco can cooler of claim 9, wherein the second cooling media comprises a gelatinous material having a freezing point below 0° C. sealed within a flexible polymer encasement.

11. The tobacco can cooler of claim 1, wherein a first pressure within the lid void is less than 1 atm.

12. The tobacco can cooler of claim 1, wherein a second pressure within the base void is less than 1 atm.

13. The tobacco can cooler of claim 1, further comprising a gasket located at an interface between the lid and the base when the lid is engaged with the base.

14. The tobacco can cooler of claim 1, wherein the lid is configured to engage with the base by a tongue and groove mechanism.

15. The tobacco can cooler of claim 1, wherein the lid is configured to engage with the base by screwing the lid onto the base.

16. The tobacco can cooler of claim 1, wherein the lid is configured to engage with the base by a twist lock mechanism.

17. The tobacco can cooler of claim 1, wherein the lid inner shell exterior profile, the lid outer shell exterior profile, the base inner shell exterior profile, and the base outer shell exterior profile each independently have a shape selected from the group consisting of cylindrical, ovular, triangular, quadrilateral, heptagonal, hexagonal, and octagonal.

18. The tobacco can cooler of claim 17, wherein the shape of each of the lid inner shell exterior profile, the lid outer shell exterior profile, the base inner shell exterior profile, and the base outer shell exterior profile are the same.

19. The tobacco can cooler of claim 17, wherein the shape of each of the lid inner shell exterior profile, the lid outer shell exterior profile, the base inner shell exterior profile, and the base outer shell exterior profile are the same as a second shape of a tobacco can.

* * * * *